United States Patent [19]

Birkle et al.

[11] 4,439,287

[45] Mar. 27, 1984

[54] METHOD FOR ANODIZING ALUMINUM MATERIALS AND ALUMINIZED PARTS

[75] Inventors: Siegfried Birkle, Hochstadt; Klaus Stoger, Nuremberg, both of Fed. Rep. of Germany; Hans De Vries, Heerde, Netherlands

[73] Assignee: Siemens Aktiengesellschaft, Berlin & Munich, Fed. Rep. of Germany

[21] Appl. No.: 480,072

[22] Filed: Mar. 29, 1983

[30] Foreign Application Priority Data

Mar. 30, 1982 [DE] Fed. Rep. of Germany ..... 3211759

[51] Int. Cl.[3] ..... C25D 11/08

[52] U.S. Cl. ..... 204/58

[58] Field of Search ..... 204/58, DIG. 8, DIG. 9

[56] References Cited

U.S. PATENT DOCUMENTS 4,188,270 2/1980 Kataoka ..... 204/58

4,188,310 2/1980 Willis et al. .

*Primary Examiner*—R. L. Andrews

*Attorney, Agent, or Firm*—Kenyon & Kenyon

[57] ABSTRACT

Aluminum materials and aluminized parts are oxidatively anodized at a bath temperature of 0° to 15° C. and preferably, 0° to 10° C. to produce an anodized layer of aluminum oxide more than 4 microns thick, which is hard, abrasion-proof and can be stained. The anodizing is bath used while conducting air free of or low in carbon dioxide through the bath. It is free of substances which limit the oxide layer to maximally a thickness of about 1 micron (forming layer) and contains 10 to 500 g trisodium phosphate or tripotassium phosphate per liter. In partially aluminized parts, no destruction of the base material occurs during the aluminizing.

8 Claims, 2 Drawing Figures

METHOD FOR ANODIZING ALUMINUM MATERIALS AND ALUMINIZED PARTS

BACKGROUND OF THE INVENTION

The invention relates to a method for anodizing aluminum materials and aluminized parts in aqueous alkaline anodizing electrolytes containing phosphate ions.

Untreated aluminum materials and aluminum-coated parts are not resistant enough to oxidation and wear for many applications, although a resistant oxide coating, which is stable in the pH-range of 5 to 9, is produced in air. This oxide coating, however, is too thin for many technical applications. Therefore, the layer can be reinforced in anodizing electrolytes.

It is known to anodize aluminum anodically, using diluted sulfuric acid (d-c sulfuric acid process), diluted oxalic acid (d-c oxalic acid process) or also in a sulfuric acid/oxalic acid bath. While these processes can be used for aluminum materials, destruction of the material or at least pitting which is not tolerable, occurs in aluminized parts if an aluminum cover is not provided on all sides.

A "method for bright anodizing of aluminum" is described in U.S. Pat. No. 4,188,270. According to U.S. Pat. No. 4,188,270 an alkaline bath with sodium phosphate as the main component is used for the preparation of bright aluminum oxide layers, maximally 4 microns thick. With a bath temperature of 20° to 90° C. and a current density of 0.5 to 80 A/dm$^2$, aluminum or aluminum alloys are bright-anodized. Apart from the fact that with this method, one works at higher temperatures when using high salt concentration electrolytes, these treatments ("burnishing processes") lead to shiny films which are often undesirable.

Since the dissolution of the aluminum proceeds faster than the formation of the oxide, only an aluminum oxide layer of less than 4 microns can be generated with the method described in this U.S. Patent even after an extended anode oxidizing time. In addition, because of the large amount of carbonate in the bath and its reaction with aluminum oxide as a result of absorption of carbon dioxide from the air, the oxide layer formation is limited to the so-called forming layer of less than 1 micron thickness after a short time in the bath. Under the anode oxidizing conditions given there, the removal rate is so high that for more thinly aluminized places of aluminized parts, the aluminum is stripped off instead of anodized. In particular, no close tolerances of the aluminum coating can be maintained by the method described in U.S. Pat. No. 4,188,270. Also, aluminum materials can thus not be provided with a thicker aluminum layer.

A special problem arises when forming an article from a combination of metallic materials with aluminum as a protective coating. When, for example, iron, copper, nickel and zinc and their alloys are to be coated, they will dissolve anodically in the known acid anodizing electrolytes (if poled anodically) if there are insufficiently coated material surfaces. In such materials, corrosion phenomena of so high a degree occur that aluminum-coated parts become unusable in decorative respects, as well as functionally, or are destroyed.

This fact limits the application of aluminizing in the decorative functional surface sector heavily, so that for example, stainable galvano-aluminum Eloxal® (Siemens trademark (oxidatively anodiyed) aluminum coated articles) films could be realized so far, for instance, on spectacle frames, cigaret lighter cases, writing instruments etc. only with difficulty from a technical point of view, or not at all.

For anodizing aluminized parts with insufficient coverage, which is carried out in acid anode oxidizing baths, it is necessary to provide the exposed places with a so-called masking varnish prior to the anode oxidizing. After the oxidizing, such varnishes must be removed by either stripping them off or dissolving them with a suitable solvent. In the case of cavities or holes, in which there is no aluminum, this can be aided by sealing them off by plugs or the like. While this procedure is in principle possible, it is technically demanding and uneconomical. For composite parts, for instance, such as those with hinges (spectacles), the foregoing masking procedure is unusable for decorative reasons (straining of the Eloxal® layers) and anodizing is therefore not possible in principle.

It is, therefore, an object of the invention to provide aluminum materials as well as aluminum-coated parts, especially ferrous materials, with hard, abrasion-proof and stainable, thick aluminum oxide layers especially having a thickness of 10 to 20 microns, while avoiding the foregoing disadvantages. Also, it is an object to provide a process which works even though the aluminum coating has defects. Such defects would include, for instance, the uncoated contact areas, or in the case of profiled parts, the uncoated places which may exist because of the limited throwing power o aluminizing processes. In the anodizing, thick aluminum oxide layers are to be generated also on partially aluminized, commonly used metals such as ferrous, nonferrous, nickel and zinc diecasting materials without destroying the base material.

SUMMARY OF THE INVENTION

These and other objects are achieved by the method of the invention which produces thick, carbonate-free oxide layers. More specifically, the process of the invention generates a mat anodizing layer more than about 4 microns and about preferably 10 to 20 microns thick without being limited by forming layers on the aluminum material or aluminized parts. The process is anode oxidation of the aluminum coating in an anodizing bath which contains 10 to 200 g trisodium phosphate or tripotassium phosphate per liter, at temperatures of 0° to 15° C., through which carbon dioxide free or low content carbon dioxide air is conducted.

DETAILED DESCRIPTION OF THE INVENTION

Figure 1:
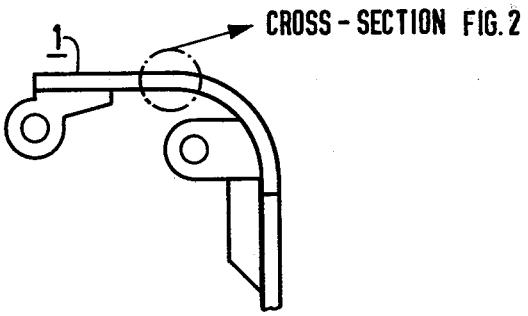
FIG. 1 shows a hinge section of a spectacle frame of silver.

According to the method of the invention, aluminum materials and aluminized parts, especially also partially aluminized parts of ferrous, nickel and non-ferrous materials as well as zinc diecasting metals, as well as parts having defects, can be oxidized anodically without disadvantages as to application, so that hard, abrasion-proof and stainable aluminum oxide layers are produced. The surfaces of aluminized parts are not shiny but retain the appearance of the deposited aluminum layers. The generated oxide layers are, in particular, thicker than 4 microns. They are characterized by extraordinary hardness and abrasion resistance. The method according to the invention is particularly well suited also for obtaining the foregoing layer properties in the case of aluminum materials.

Particularly advantageous effects are obtained if the bath is operated at 0° to 10° C. The bath can be operated with d-c or pulsed current.

For practising the method according to the invention, baths are advantageously used which contain 50 to 150 g/l trisodium phosphate or tripotassium phosphate.

Visually, the most uniform anodizing layers are obtained if 1 to 20 g of a sequestering agent per liter of anodizing bath is added. Such agents are, for example, alkali metal and alkaline earth metal cyanides. Preferably, 1 to 6 g sodium cyanide per liter are added to the bath.

The method according to the invention is suitable for anodizing aluminum materials, flame-sprayed aluminum layers and roll-bonded aluminum layers, fired aluminum layers, PVD aluminum layers and in particular, IVD and galvano-aluminum layers.

"Galvano-aluminum" is a high-purity (better than 99.99%) aluminum with good electric conductivity and high ductility (better than 20 HV) which is obtained by precipitation from organo-aluminum electrolytes.

For example, hollow bodies which are aluminized only on the outside as well as work pieces with partially uncovered areas, such as equipment parts with movable hinges (e.g. spectacles), which cannot have a continuous coat of aluminum, can be anode oxidized to advantage according to the invention. The resulting product is covered with hard, abrasion-proof and stainable aluminum oxide layers having thicknesses of 10 to 20 microns.

The invention, which is fully described by the foregoing explanation, will be illustrated in greater detail with the aid of the examples and the figure.

EXAMPLE 1

Steel Sheets With Aluminum Coating

First, steel sheets (50×100×1 mm) were provided with a mat galvano-aluminum layer by electroplating in an aluminum electrolyte with the following composition.

NaF: 7.25% by weight
$Al(C_2H_5)_3$: 39.50% by weight
Toluol: 52.25% by weight
Bath temperature approx. 100° C.
Aluminum layer thickness approx. 15 pm After a brief pickling operation, they were dipped in diluted sodium hydroxide in an anode oxidizing electrolyte composed of 30 l deionized water
1.5 kg $Na_3PO_4.12H_2O$
and anodized as follows:
anode oxidizing temperature: 5° C.
anode oxidizing voltage: 20 V (constant)
Current density: 1.5 to 2 A/dm$^2$
Exposure time: 30 min
Electrolyte circulation with carbon dioxide free compressed air.

A transparent aluminum oxide layer about 10 microns thick was obtained. The unaluminized contact areas were essentially not attacked.

A previously mat aluminum surface which was anode oxidized in comparison thereto in accordance with DE-OS No. 28 42 396 at 20° C. had a shiny appearance. The unaluminized contact areas showed a corrosion which was not tolerable for the application intended. In addition, it was possible to generate only aluminum oxide layers maximally 3 to 4 microns thick even with thick aluminum layers.

EXAMPLE 2

Aluminized Silver Spectacles 6 spectacle frames of German silver were aluminized in an aluminizing electrolyte as given in Example 1 for one-half hour. The average aluminum layer thickness at the spectacle bow and the lens setting was about 20 microns, but at the corner of the hinges, 1 to 3 microns.

After a brief pickling operation in diluted sodium hydroxide, the spectacle frames were treated in an anodizing bath as described in Example 1.

In contrast thereto, the spectacle frames 4 to 6 treated, after pickling, in an electrolyte of the following composition, where anodizing conditions the name as those used for frames 1 to 3 were chosen:

30 l deionized water
1.5 kg $Na_3PO_4.12H_2O$
90 g NaCN.

Figure 2:
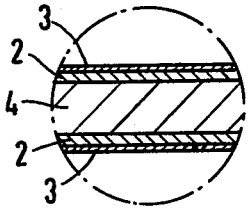
FIG. 2 shows a cross-section of the layered silver rod forming the frame.

As shown in FIG. 1, hinge 1 of German silver was coated with aluminum. As shown in FIG. 2, the layers were oxide layer 3, aluminum layer 2 and silver layer 4. In both cases, an aluminum oxide layer of about 10 microns was obtained. The appearance of the spectacles was the same except for the corners of the hinges.

While the spectacle frames 1 to 3 looked less uniform at the hinges after staining, the spectacle frames 4 to 6 presented a uniform visual appearance. It resulted therefrom that the sequestering agent contributes to a more homogeneous oxide formation at the phase boundary to the aluminum.

What is claimed is:

1. A method for oxidatively anodizing aluminum or aluminized parts comprising performing the oxidative anodization of said parts in an aqueous alkaline, anodizing electrolyte containing 10 to 200 g trisodium phosphate or tripotassium phosphate, at temperatures of 0° to 15° C., while conducting carbon dioxide free or low content carbon dioxide air through the solution, to produce an outer aluminum oxide layer more than about 4 microns thick on said parts, said outer aluminum oxide layer being dull rather than shiny and being free of a forming layer generated by the reaction of aluminum oxide and carbonate anion, said forming layer being able to limit the thickness of an aluminum oxide layer generated by anodic oxidation.

2. A method according to claim 1, comprising operating the anodizing bath with d-c or pulsed current.

3. A method according to claim 1 comprising performing the anodization at 0° to 10° C.

4. A method according to claim 1 comprising performing the anodization in a bath containing 50 to 150 g $Na_3PO_4.12H_2O$ or $K_3PO_4.7H_2O$ per liter.

5. A method according to claim 1 further comprising performing the anodization in a bath containing in addition 1 to 20 g of a sequestering agent per liter.

6. A method according to claim 5, comprising using a bath containing 1 to 6 g sodium cyanide per liter.

7. A method according to claim 1 wherein the outer aluminum oxide layer produced is about 4 to 20 microns thick.

8. A method according to claim 1 wherein the outer aluminum oxide layer produced is about 10 to 20 microns thick.

* * * * *